US011287129B2

(12) United States Patent
Crawford et al.

(10) Patent No.: US 11,287,129 B2
(45) Date of Patent: Mar. 29, 2022

(54) COMBUSTION-POWERED FASTENER DRIVING TOOL FUEL CELL ASSEMBLY

(71) Applicant: Illinois Tool Works Inc., Glenview, IL (US)

(72) Inventors: Ronald Brett Crawford, Randolph, MS (US); Maureen L. Shea, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 129 days.

(21) Appl. No.: 16/820,022

(22) Filed: Mar. 16, 2020

(65) Prior Publication Data

US 2020/0232642 A1 Jul. 23, 2020

Related U.S. Application Data

(63) Continuation of application No. 15/590,109, filed on May 9, 2017, now Pat. No. 10,598,377.

(Continued)

(51) Int. Cl.

*B25C 1/08* (2006.01)
*F23K 5/14* (2006.01)

(Continued)

(52) U.S. Cl.

CPC ..... *F23K 5/14* (2013.01); *B25C 1/04* (2013.01); *B25C 1/08* (2013.01); *B25D 9/10* (2013.01);

(Continued)

(58) Field of Classification Search

CPC .. B25C 1/04; B25C 1/08; B25C 1/005; B25C 1/008; B65D 83/14; B65D 83/38;

(Continued)

(56) References Cited

U.S. PATENT DOCUMENTS 4,403,722 A 9/1983 Nikolich
4,483,474 A 11/1984 Nikolich (Continued)

FOREIGN PATENT DOCUMENTS

EP 1254745 11/2002
EP 2119535 11/2009
EP 2815851 12/2014

OTHER PUBLICATIONS

ECKO MultiCell, ECKO Fastening Systems, Available prior to May 27, 2016, (4 pages).

(Continued)

*Primary Examiner* — Scott A Smith

(74) *Attorney, Agent, or Firm* — Neal, Gerber & Eisenberg LLP

(57) ABSTRACT

Various embodiments of the present disclosure provide a combustion-powered fastener driving tool fuel cell assembly including a fuel cell, fuel cell adapter, and fuel cell adapter cap for a combustion-powered fastener driving tool. The fuel cell, the fuel cell adapter, and the fuel cell adapter cap enable both the fuel cell adapter and the fuel cell adapter cap to be attached to a fuel cell and particularly a sealing member of the fuel cell in one efficient step. This single step process can be done manually or automatically, and is substantially more efficient and less time-consuming than the known fuel cell assemblies.

8 Claims, 11 Drawing Sheets

Related U.S. Application Data

(60) Provisional application No. 62/342,555, filed on May 27, 2016.

(51) Int. Cl.

| | |
|---|---|
| ***F17C 13/04*** | (2006.01) |
| ***B25C 1/04*** | (2006.01) |
| ***B25D 9/10*** | (2006.01) |
| ***F23D 14/28*** | (2006.01) |
| *B65D 83/14* | (2006.01) |
| *B65D 83/54* | (2006.01) |

(52) U.S. Cl.

CPC ..... *F17C 13/04* (2013.01); *F23D 14/28* (2013.01); *B65D 83/14* (2013.01); *B65D 83/54* (2013.01); *F17C 2205/0373* (2013.01); *F17C 2270/0545* (2013.01); *F17C 2270/0763* (2013.01)

(58) Field of Classification Search

CPC ..... B65D 83/54; B65D 83/207; F17C 13/04; F17C 2205/0323; F17C 2205/0373; F17C 2205/0335; F17C 2270/0545; F17C 2270/0763

USPC .... 227/8, 9, 10, 130, 156; 123/46 R, 46 SC; 222/105, 402.1

See application file for complete search history.

(56) References Cited

U.S. PATENT DOCUMENTS

| | | | |
|---|---|---|---|
| 4,522,162 | A | 6/1985 | Nikolich |
| D294,820 | S | 3/1988 | Belletire |
| 5,115,944 | A | 5/1992 | Nikolich |
| 5,730,326 | A | 3/1998 | Kaeser |
| D405,315 | S | 2/1999 | Lioi |
| D420,462 | S | 2/2000 | Menter |
| 6,095,704 | A | 8/2000 | Jaeger et al. |
| 6,176,412 | B1 | 1/2001 | Weinger et al. |
| 6,217,085 | B1 | 4/2001 | Toulouse |
| 6,302,297 | B1 | 10/2001 | Richardson et al. |
| D457,811 | S | 5/2002 | Vanstaan et al. |
| 6,371,338 | B1 | 8/2002 | Klein et al. |
| 6,796,478 | B2 | 9/2004 | Shkolnikov et al. |
| 7,392,922 | B2 | 1/2008 | Vanstaan et al. |
| D568,499 | S | 5/2008 | Foo |
| 7,478,740 | B2 | 1/2009 | Shea et al. |
| 7,571,841 | B2 | 8/2009 | Gibson et al. |
| 7,591,249 | B2 | 9/2009 | Wagdy et al. |
| 7,654,429 | B2 | 2/2010 | Shea et al. |
| 7,661,568 | B2 | 2/2010 | Vanstaan et al. |
| 7,757,920 | B2 | 7/2010 | Shea et al. |
| D633,922 | S | 3/2011 | Shea et al. |
| D645,053 | S | 9/2011 | Shea et al. |
| 8,302,831 | B2 | 11/2012 | Taylor et al. |
| D681,677 | S | 5/2013 | Shea et al. |
| 8,505,796 | B2 | 8/2013 | Aihara |
| D721,789 | S | 1/2015 | Lu |
| 8,939,339 | B2 | 1/2015 | Vanstaan et al. |
| D739,919 | S | 9/2015 | Alexander et al. |
| 9,381,636 | B2 | 7/2016 | Aihara |
| 9,505,509 | B2 | 11/2016 | Smith |
| D787,326 | S | 5/2017 | Hanson et al. |
| 9,802,303 | B2 | 10/2017 | Vanstaan |
| D816,774 | S | 5/2018 | Edevold |
| 10,166,666 | B2 | 1/2019 | Shea |
| D875,139 | S | 2/2020 | Crawford et al. |
| 10,598,377 | B2 * | 3/2020 | Crawford ..... F17C 13/04 |
| 2002/0043547 | A1 | 4/2002 | Shkolnikov et al. |
| 2004/0206798 | A1 | 10/2004 | Robinson |
| 2005/0045072 | A1 | 10/2005 | Vanstaan et al. |
| 2007/0251376 | A1 | 11/2007 | Toulouse |
| 2007/0251967 | A1 | 11/2007 | Taylor |
| 2008/0000451 | A1 | 1/2008 | Shea et al. |
| 2008/0110953 | A1 | 5/2008 | Gibson et al. |
| 2010/0170404 | A1 | 7/2010 | Hensel et al. |
| 2014/0175143 | A1 | 6/2014 | Vanstaan et al. |
| 2016/0045072 | A1 | 2/2016 | Myoung |
| 2017/0343211 | A1 | 11/2017 | Crawford |

OTHER PUBLICATIONS

ECKO FuelCell Cordless Fastening System Images, Available prior to May 27, 2016 (3 pages).

European Patent Office as International Searching Authority, International Search Report and Written Opinion in Application No. PCT/US2016/062529, dated Mar. 21, 2017 (11 pages).

International Search Report and Written Opinion for International Application No. PCT/US2017/031935, dated Sep. 28, 2017 (12 pages).

Paslode Quicklode Fuel Cartridge Image, http://static.grainger,com/rp/s/is/image/Grainger/31EE19_AS01?hei=800&wid=935, Jan. 19, 2016, (1 page).

Yagid, Rob, "Cordless finish nailer", HowItWorks, The Taunton Press, Inc. Jun./Jul. 2011, (2 pages).

* cited by examiner

COMBUSTION-POWERED FASTENER DRIVING TOOL FUEL CELL ASSEMBLY

PRIORITY CLAIM

This application is a continuation of, and claims priority to and the benefit of, U.S. patent application Ser. No. 15/590,109, filed on May 9, 2017, now U.S. Pat. No. 10,598,377, which claims priority to and the benefit of U.S. Provisional Patent Application No. 62/342,555, filed on May 27, 2016, the entire contents of each of which is incorporated by reference herein.

BACKGROUND

Powered fastener driving tools are well known and commercially widely used throughout the world. Powered fastener driving tools are typically electrically powered, pneumatically powered, combustion-powered, or powder activated. Powered fastener driving tools are typically used to drive fasteners (such as nails, staples, and the like) to connect a first material, item, or workpiece to a second material, item, workpiece, or object.

Various known powered fastener driving tools typically include: (a) a housing; (b) a power source or supply assembly in, connected to, or supported by the housing; (c) a fastener supply assembly in, connected to, or supported by the housing; (d) a fastener driving assembly in, connected to, or supported by the housing; (e) a trigger mechanism partially in, connected to, or supported by the housing; and (f) a workpiece contactor or contacting element (sometimes referred to herein as a "WCE") connected to or supported by the housing. The WCE is configured to engage or contact a workpiece and to operatively work with the trigger mechanism such that the WCE needs to be depressed or moved inwardly a predetermined distance with respect to the housing before activation of the trigger mechanism causes actuation of the power fastener driving tool.

Powered fastener driving tools typically have two different types of operational modes and one or more mechanisms that enable the operator to optionally select one of the two different types of operational modes that the operator desires to use for driving the fasteners. One operational mode is known in the industry as the sequential or single actuation operational mode. In this operational mode, the depression or actuation of the trigger mechanism will not (by itself) initiate the actuation of the powered fastener driving tool and the driving of a fastener into the workpiece unless the WCE is sufficiently depressed against the workpiece. In other words, to operate the powered fastener driving tool in accordance with the sequential or single actuation operational mode, the WCE must first be depressed against the workpiece followed by the depression or actuation of the trigger mechanism. Another operational mode is known in the industry as the contact actuation operational mode. In this operational mode, the operator can maintain the trigger mechanism at or in its depressed position, and subsequently, each time the WCE is in contact with, and sufficiently pressed against the workpiece, the power fastener driving tool will actuate, thereby driving a fastener into the workpiece.

As mentioned above, various known powered fastener driving tools are combustion-powered. Combustion-powered fastener driving tools are typically powered by a rechargeable battery pack and a replaceable and detachable fuel cell.

Two different types of combustion-powered fastener driving tools are well known. A first well known type of combustion-powered fastener driving tool is an "on-can" tool that uses a fuel cell to deliver the appropriate amount of fuel to the tool. Fuel cells configured for use with external metering valves are of the "on-can" type. A second well known type of combustion-powered fastener driving tool is an "in-can" tool that uses a fuel cell to deliver the appropriate amount of fuel to the tool. Fuel cells that have internal metering valves are of the "in-can" type.

Such fastener driving tools and fuel cells have been available commercially from ITW-Paslode of Vernon Hills, Ill. (a division of Illinois Tool Works, Inc., the assignee of this application).

Referring now to FIGS. 2 and 3, a known fuel cell 10, a known fuel cell adapter 20, a known fuel cell cap 30 for the fuel cell 10, and a known on-can metering valve 40 are generally shown. This known and widely commercially used fuel cell 10 and fuel cell adapter 20 are configured to accommodate or work with both in-can and on-can type combustion-powered fastener driving tools. More specifically, this fuel cell 10 and known fuel cell adapter 20 can be directly used for in-can type combustion-powered fastener driving tools (such as shown in FIG. 1A), and this known adapter 20 can be removed from the fuel cell 10 to enable the fuel cell 10 to be used with the metering valve 40 for an on-can type combustion-powered fastener driving tool (such as shown in FIG. 1B, with like reference numbers referring to like parts).

Assembling this known fuel cell arrangement before packaging and sale is problematic. To attach this known fuel cell adapter 20 to the fuel cell 10, one must screw the fuel cell adapter into the sealing member 15 of the fuel cell 10. Assembly is therefore a three-part process: (1) the assembler places the bottom of the fuel cell adapter 20 into the sealing member 15; (2) the assembler rotates the fuel cell adapter 20 relative to the sealing member 15 until grooves of the sealing member 15 (not shown) receive corresponding tongues (not shown) of the fuel cell adapter 20; and (3) the assembler pushes the fuel cell adapter 20 toward the sealing member 15 while twisting the fuel cell adapter 20 relative to the sealing member 15 until the tongues reach the ends of the corresponding grooves. The assembler then places the fuel cell cap 30 over the fuel cell adapter 20 and directly attaches it to the fuel cell 10.

This manual three-step manual process is relatively time-consuming and inefficient. Further, it can be difficult for an operator to remove the fuel cell adapter 20 from the sealing member 15, such as when the assembler screws the fuel cell adapter 20 too tightly onto the sealing member 15. Additionally, while the fuel cell cap is needed for packaging and shipping, once the fuel cell cap 30 is removed, it serves no purpose and is typically thrown away.

Accordingly, there is a need to provide fuel cells and related components for combustion-powered fastener driving tools that solve these problems.

SUMMARY

Various embodiments of the present disclosure provide a combustion-powered fastener driving tool fuel cell assembly including a fuel cell, a fuel cell adapter, and a fuel cell adapter cap for a combustion-powered fastener driving tool that solves the above problems.

The fuel cell, the fuel cell adapter, and the fuel cell adapter cap of various embodiments of the present disclosure enable both the fuel cell adapter and the fuel cell adapter cap to be removably attached to the fuel cell, and particularly removably attached to the sealing member of the fuel cell in one efficient step. This single step process can be done manually or automatically, and is thus substantially more efficient and less time consuming than the known apparatus described above.

In various embodiments of the present disclosure, the combustion-powered fastener driving tool fuel cell assembly includes a fuel cell including: (a) a housing including a substantially cylindrical fuel cell wall having a lip defining an open upper end, a bottom end wall connected to the fuel cell wall, and a closure sealingly secured to the lip; (b) a sealing member including an outer ring engaging and gripping the closure such that the sealing member is non-rotatable relative to the closure and the outer housing, the ring including a top edge, a bottom edge, an inner sidewall, and an outer sidewall, the inner sidewall defining a plurality of grooves configured to receive opposing extending adapter tongues, and (c) a stem extending from the housing through the closure and through the sealing member.

In various embodiments of the present disclosure, the combustion-powered fastener driving tool fuel cell assembly includes a fuel cell adapter including: (a) a tubular body having an outer surface, an inner surface, a bottom edge, and top portion; (b) a locking flange extending radially outward from the top portion of the body; (c) a plurality of spaced-apart engagement ridges extending radially outwardly from the outer surface of the body; and (d) a hub disposed within the body and including a base and a nozzle extending from the base, the nozzle configured to fit over the stem of the fuel cell.

In various embodiments of the present disclosure, the combustion-powered fastener driving tool fuel cell assembly includes a fuel cell adapter cap including: (a) a side wall having an outer surface, an inner surface, a bottom edge, and a top end; (b) a top wall integrally connected to the side wall, and (c) an engagement arm extending radially outward from the side wall, the engagement arm including a plurality of circumferentially spaced-apart downwardly extending engagement hands, each engagement hand including an inwardly-extending engagement finger, the engagement arm, the engagement hands, and the engagement fingers configured to securely and releasably engage the outwardly extending locking flange of the fuel cell adapter.

The fuel cell adapter cap can be attached to the fuel cell adapter before attachment to the fuel cell. This can also be done in a separate operation and/or facility to save time. To secure the fuel cell adapter and the fuel cell adapter end cap to the fuel cell, the hub of the fuel cell adapter is aligned with the valve stem of the fuel cell. Once properly aligned, the fuel cell adapter end cap and fuel cell adapter can be pushed into the sealing member of the fuel cell, or vice-versa. This single step process can be done manually or automatically and thus is substantially more efficient and less time consuming than the installation process for the known fuel cell adapter described above.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 3:
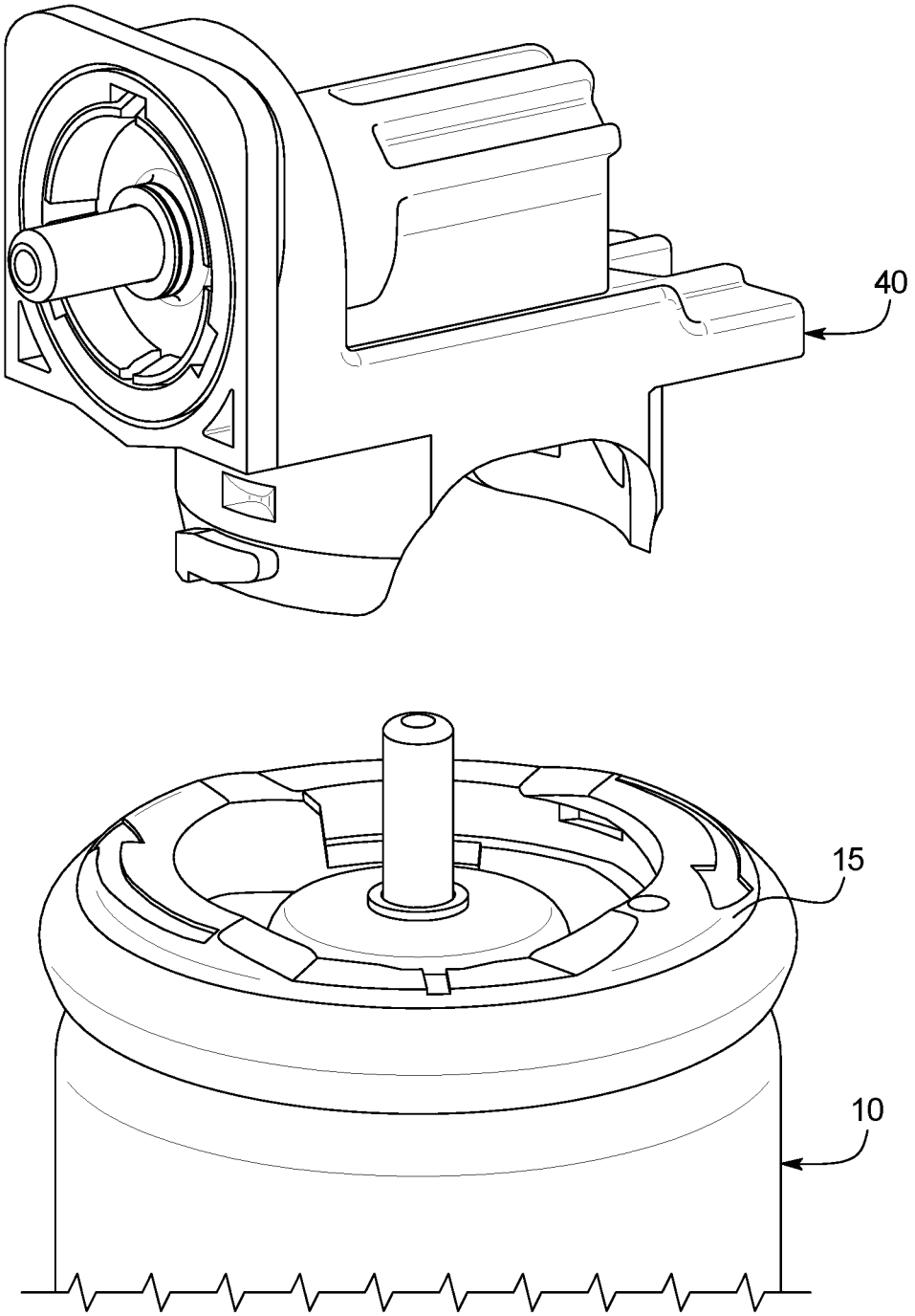
FIG. 3 PRIOR ART
FIG. 3 is a partially exploded front perspective view of the known fuel cell (shown in fragmentary) of FIG. 2 and of a known on-can metering valve removed from the fuel cell.
Figure 4:
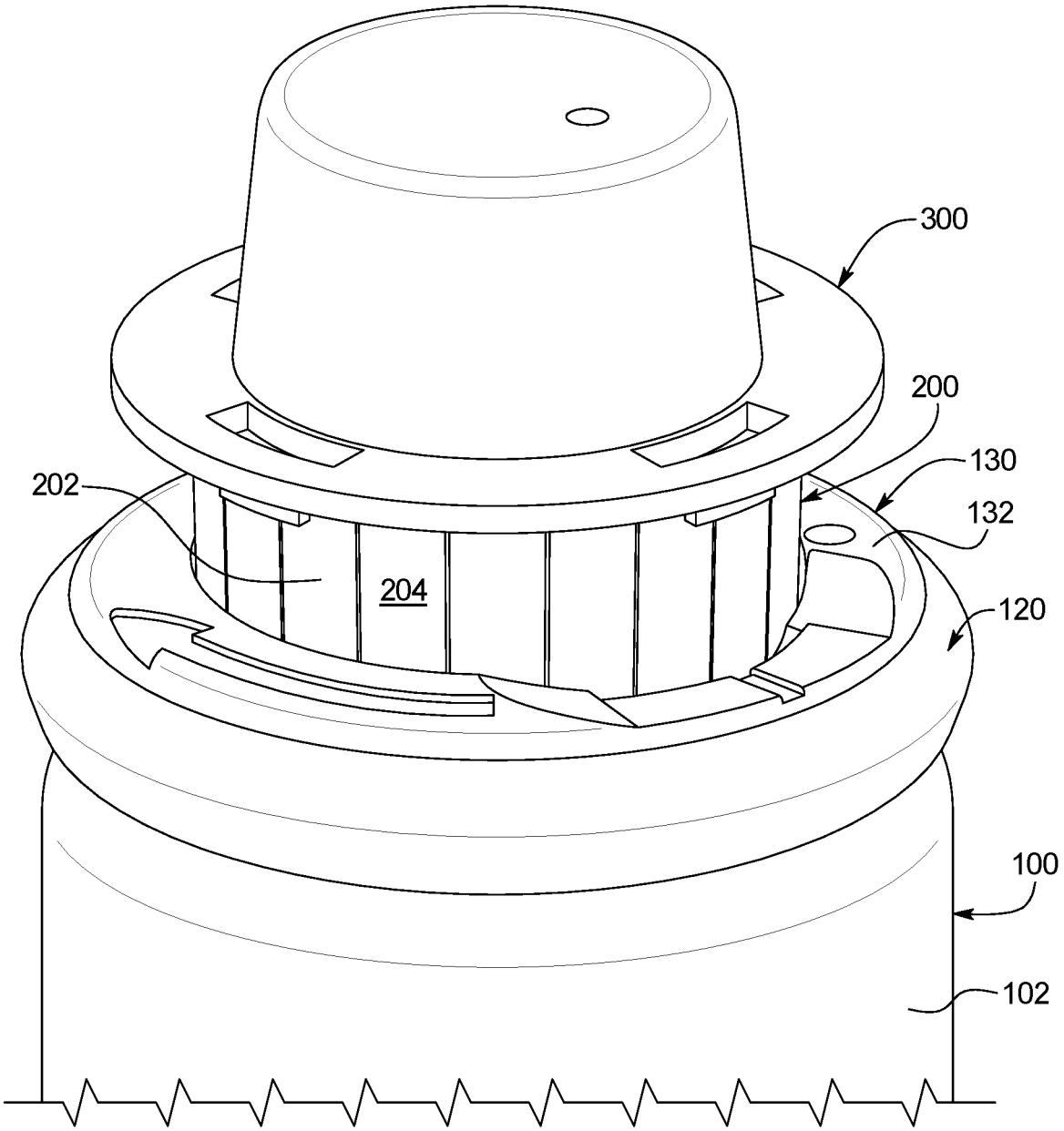
FIG. 4 is a front perspective view of one example embodiment of a fuel cell (shown in fragmentary) of the present disclosure, a fuel cell adapter of the present disclosure attached to the fuel cell, and a fuel cell adapter cap of the present disclosure attached to the fuel cell adapter.
Figure 5:
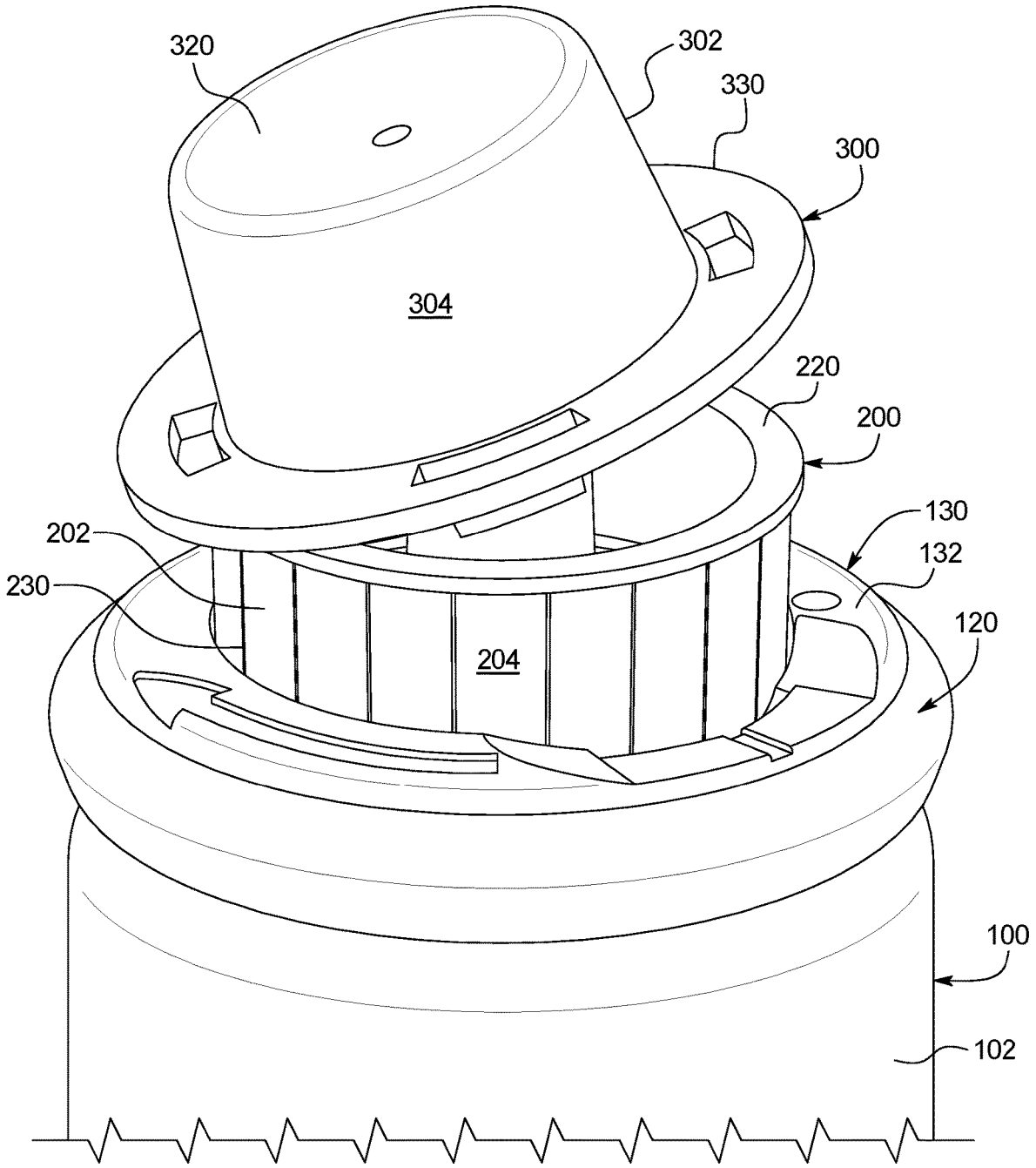
FIG. 5 is a front perspective view of the fuel cell (shown in fragmentary), the fuel cell adapter, and the fuel cell adapter cap of FIG. 4 with the fuel cell adapter attached to the fuel cell and the fuel cell adapter end cap being removed from the fuel cell adapter.
Figure 6:
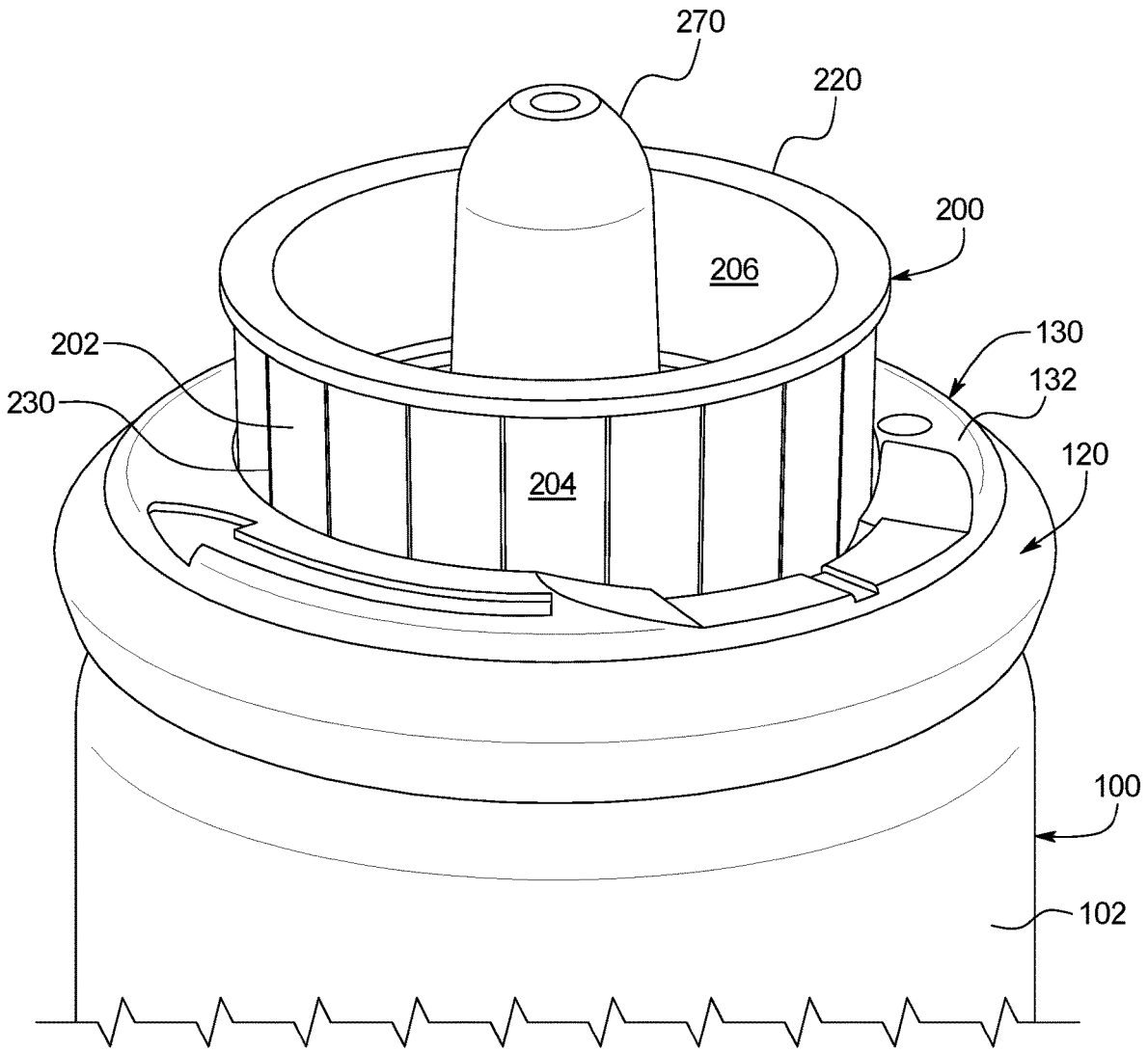
FIG. 6 is a front perspective view of the fuel cell (shown in fragmentary) and the fuel cell adapter of FIG. 4 with the fuel cell adapter attached to the fuel cell.
Figure 7:
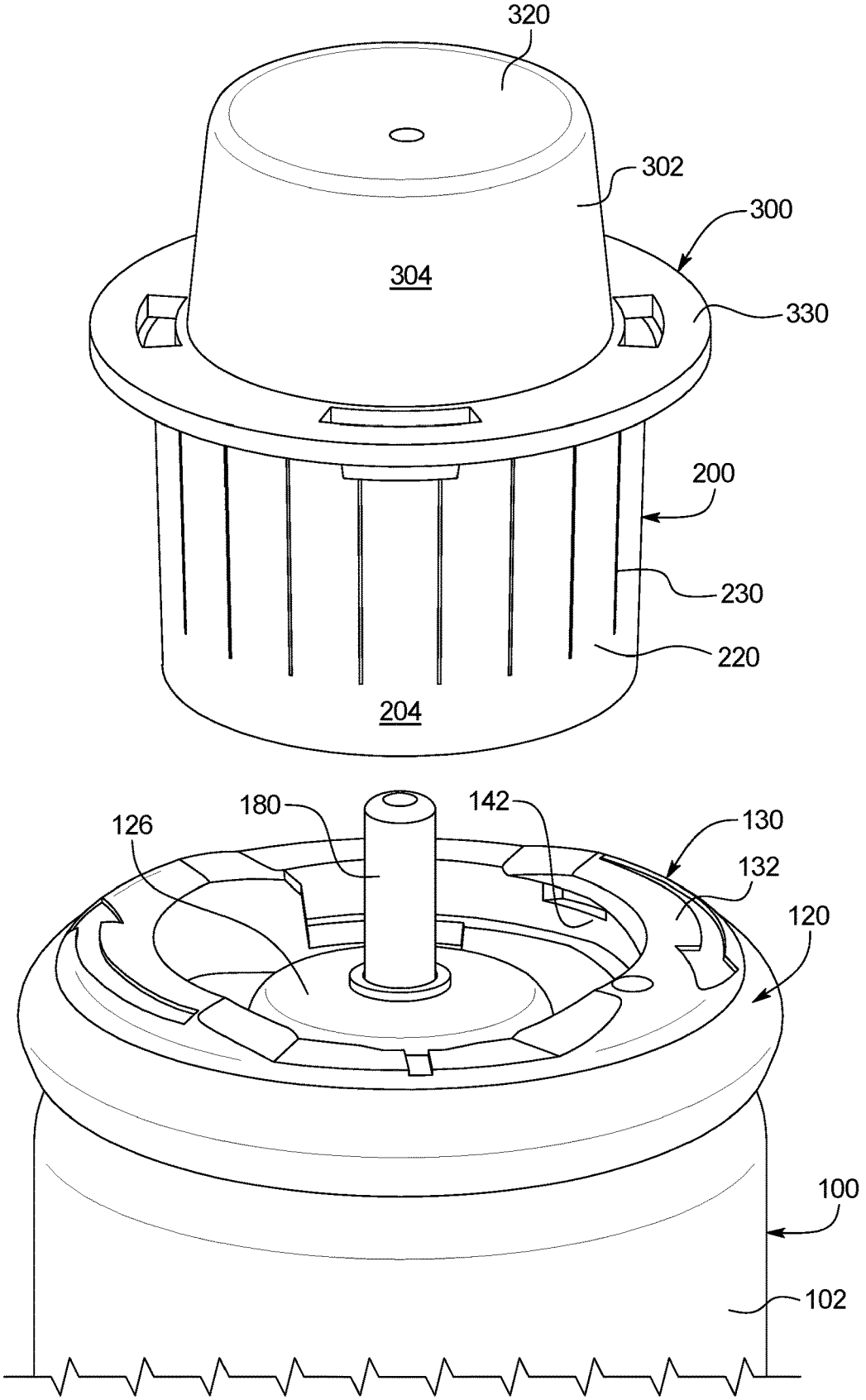
FIG. 7 is a front partially exploded perspective view of the fuel cell (shown in fragmentary), the fuel cell adapter, and the fuel cell adapter cap of FIG. 4 with the fuel cell adapter removed from the fuel cell and the fuel cell adapter end cap attached to the fuel cell adapter.
Figure 8:
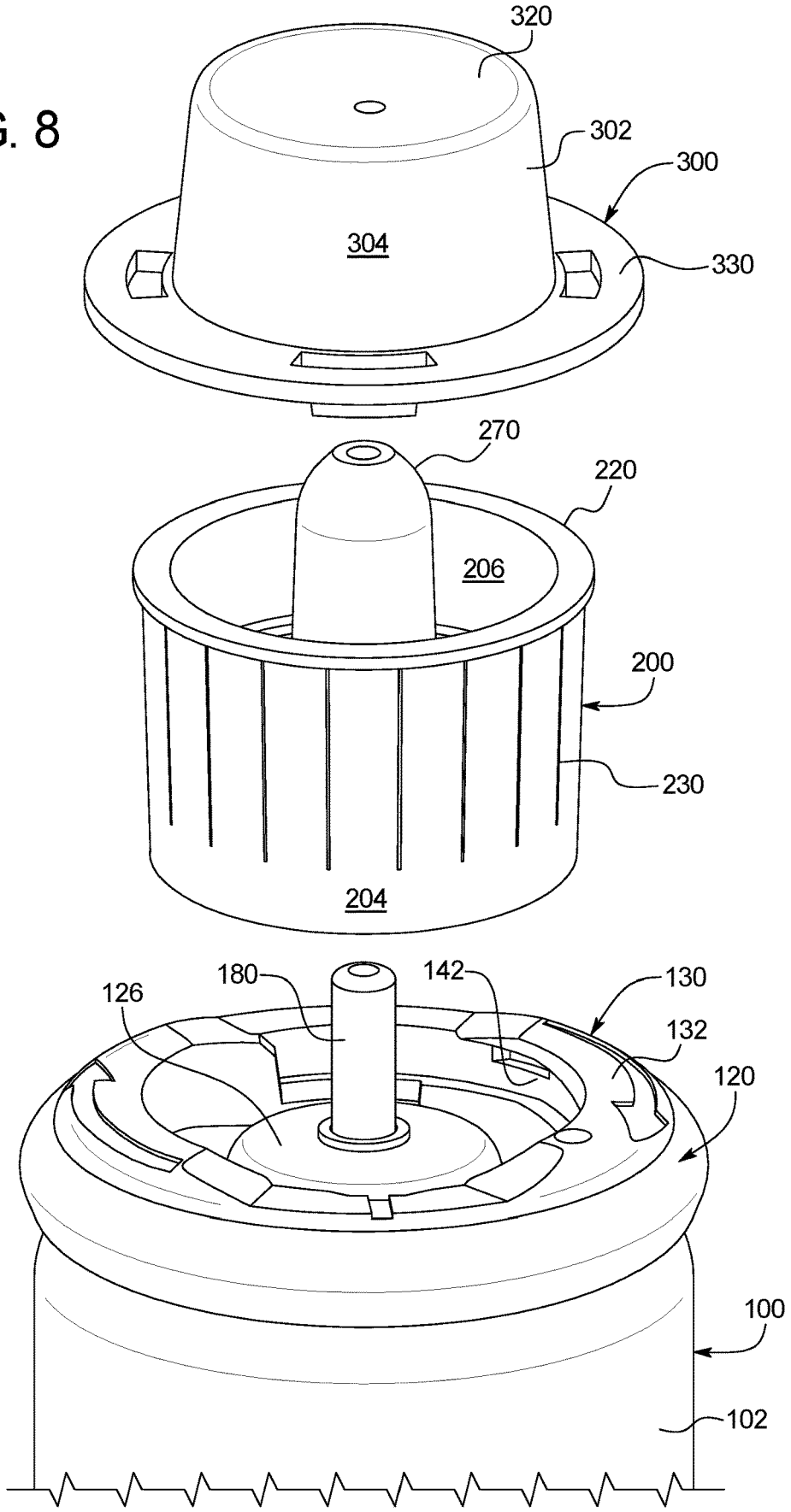
FIG. 8 is a front exploded perspective view of the fuel cell (shown in fragmentary), the fuel cell adapter, and the fuel cell adapter cap of FIG. 4 with the fuel cell adapter removed from the fuel cell and with the fuel cell adapter cap removed from the fuel cell adapter.

Referring now to the drawings, a combustion-powered fastener driving tool fuel cell assembly including a fuel cell 100, a fuel cell adapter 200, and a fuel cell adapter cap 300 of one example embodiment of the present disclosure is generally shown in FIGS. 4, 5, 6, 7, 8, 9, and 10. The fuel cell 100 and the fuel cell adapter 200 are configured for use with an in-can type combustion fastener driving tool, such as the fastener driving tool generally shown in FIG. 1A and generally indicated by numeral 50. The fuel cell adapter 200 (and fuel cell adapter cap 300 removably attached thereto) is removably attached to the fuel cell 100 such that one can easily remove the fuel cell adapter 200 from the fuel cell 100 to enable use of the fuel cell 100 with a metering valve (such as the metering valve 40 shown in FIG. 3) of an on-can type combustion fastener driving tool (such as the one shown in FIG. 1B).

Figure 1A:
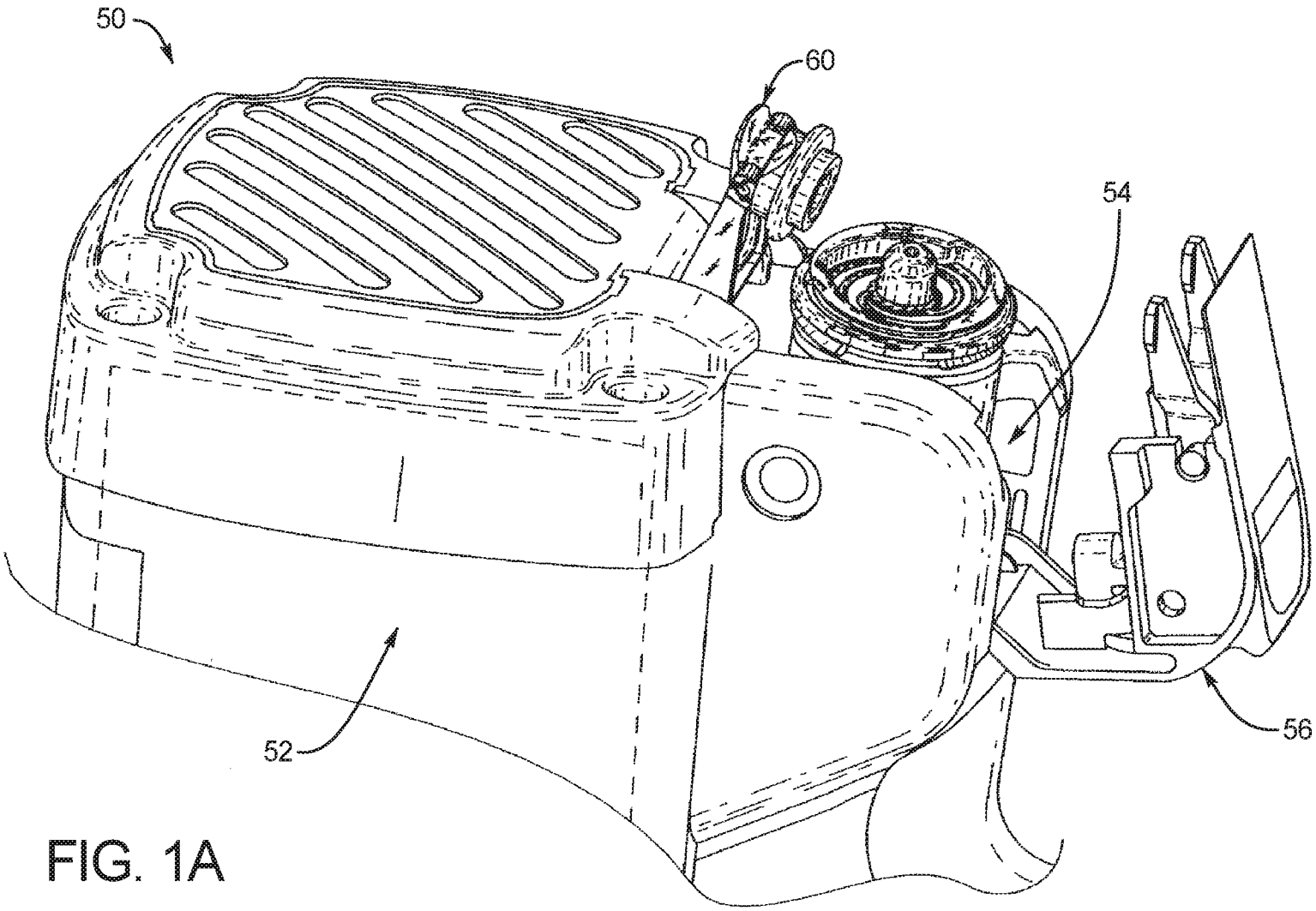
FIGS. 1A and 1B are fragmentary top perspective views of a known in-can type combustion fastener driving tool and a known on-can type combustion fastener driving tool, respectively.
Figure 1B:
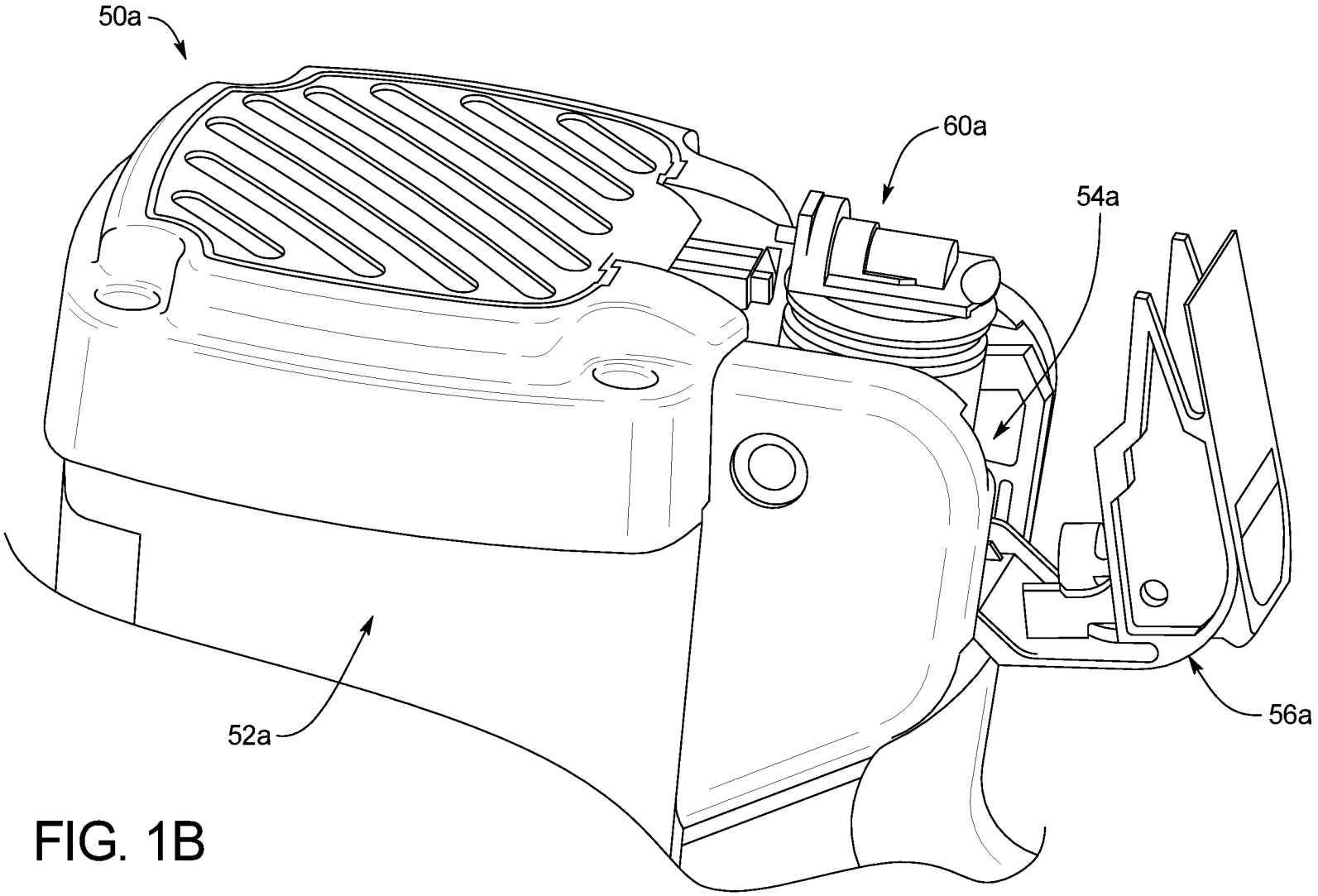
Figure 2:
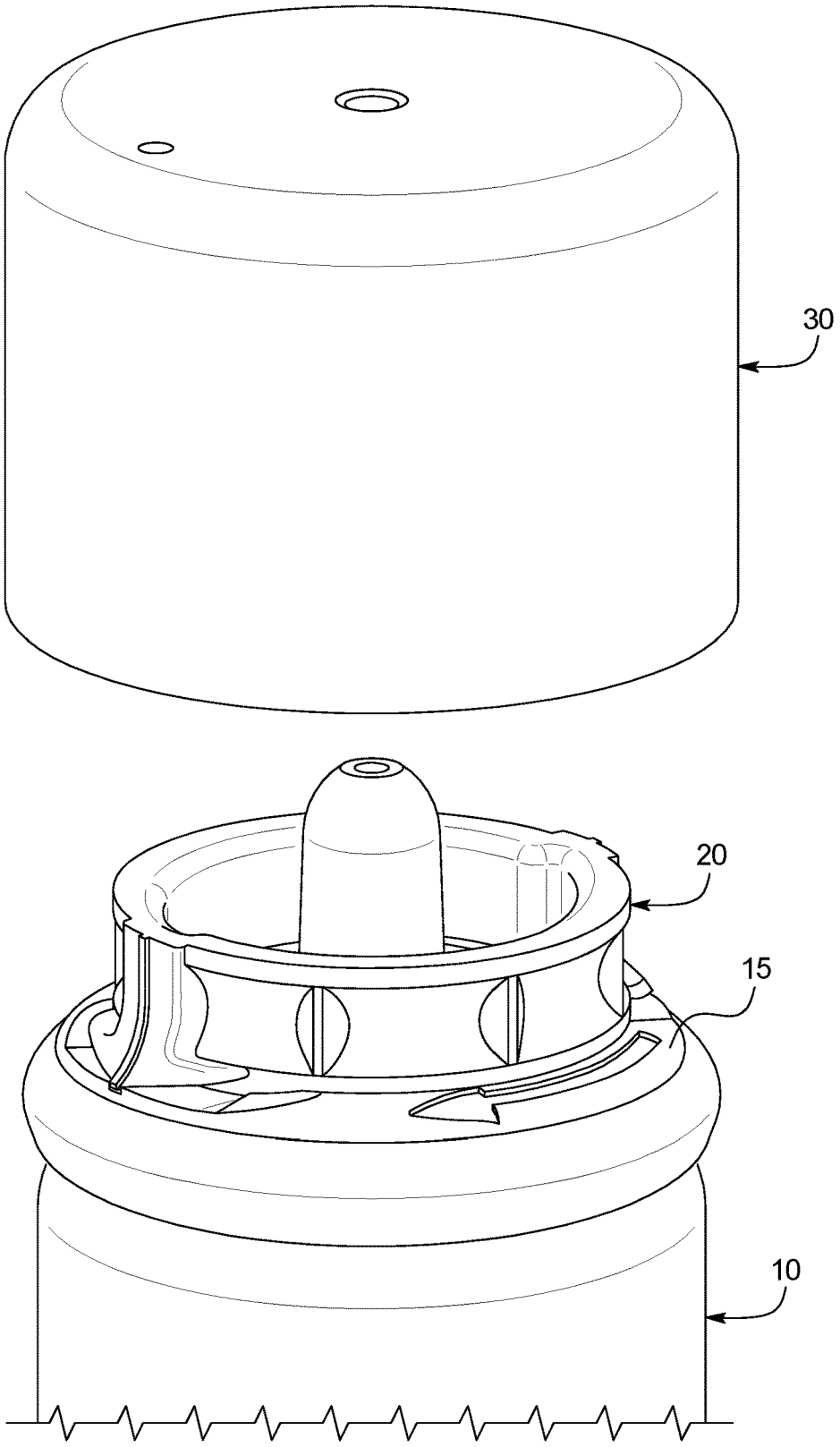
FIG. 2 PRIOR ART
FIG. 2 is a partially exploded front perspective view of a known fuel cell (shown in fragmentary), a known fuel cell adapter attached to the fuel cell, and a known fuel cell cap removed from the fuel cell.

The illustrated example in-can type combustion fastener driving tool 50 shown in FIG. 1A generally includes a housing 52 having a combustion chamber (not shown) and a fuel cell chamber 54 configured to receive an in-can fuel cell such as the fuel cell 100 with the fuel cell adapter 200. The tool 50 includes a fuel cell door 56 pivotally connected to the housing 52 and configured to open and close the fuel cell chamber 54. The tool 50 further includes a fuel cell actuator assembly 60 pivotally connected to the housing 52 and having an actuator configured to exert an axial force on the fuel cell valve stem 180. This axial force causes the fuel cell 100 to dispense a measured dose of fuel through the valve stem 180 and into the combustion chamber before each combustion event to initiate combustion. The actuator assembly 60 includes an actuator block (not labeled) that delivers fuel to a fuel conduit (not shown) and ultimately to the combustion chamber.

In certain such in-can type combustion fastener driving tools, retraction of the WCE (not shown) activates the actuator assembly. More specifically, as the WCE is pressed against a workpiece (not shown) before driving a fastener (not shown), the WCE retracts relative to a nosepiece (not shown) of the tool. This retraction mechanically triggers certain operations of the tool, such as the closing of the combustion chamber. In certain known combustion-powered fastener driving tools, the movement of the WCE relative to the nosepiece initiates the axial force on the fuel valve stem to dispense the fuel.

Figure 10:
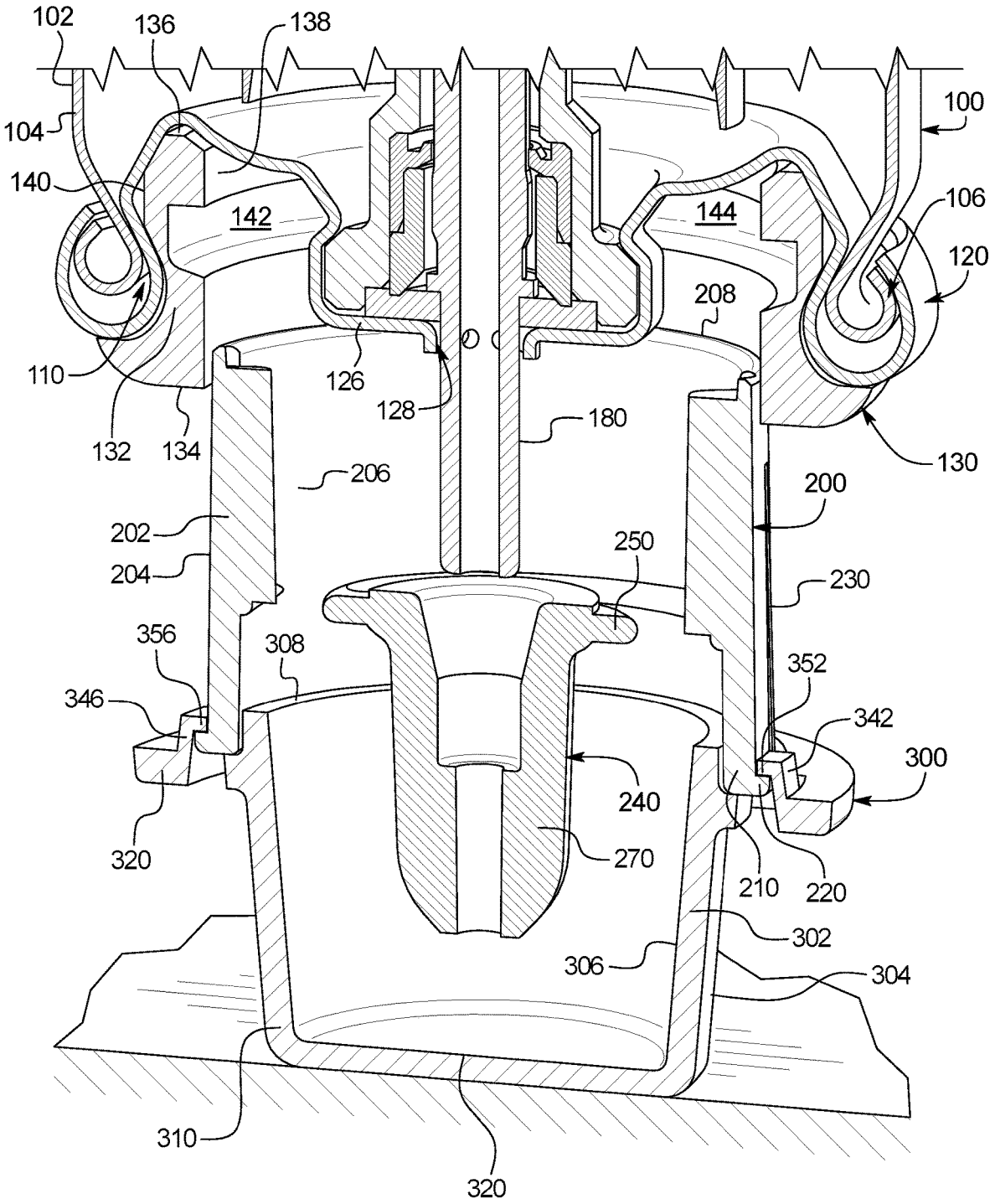
FIG. 10 is an cross-sectional view of the fuel cell (shown in fragmentary), the fuel cell adapter, and the fuel cell adapter cap of FIG. 4 upside-down with the fuel cell adapter attached to the fuel cell and the fuel cell adapter cap attached to the fuel cell adapter and resting on a supporting surface before the complete attachment of the fuel cell to the fuel cell adapter and the fuel cell adapter cap.

This illustrated fuel cell 100 is an "in-can" type fuel cell because it has an internal fuel-metering valve (not shown) including a fuel-metering chamber. The fuel cell 100 includes an outer housing 102 having a cylindrical wall 104 and a bottom end wall (not shown) connected to the cylindrical wall 104. The upper end of the cylindrical wall 104 includes a cylindrical lip 106 (shown in FIG. 10) that defines an open upper end 110. The fuel cell 100 further includes a cylindrical closure 120 sealingly secured to the cylindrical wall 104 of the housing 102, and particularly to the cylindrical lip 106 of the housing 102. The closure 120 is crimped over the cylindrical lip 106 in this illustrated embodiment as best shown in FIG. 10. The closure includes a hub 126 that defines an opening 128 through which the valve stem 180 of the fuel cell 100 extends. The general construction of these fuel cells is disclosed in U.S. Pat. Nos. 7,392,922 and 7,591,249.

The fuel cell 100 includes a suitable biasing element that biases the fuel valve stem 180 to a closed or resting position, as best shown in FIG. 10. When the fuel valve stem 180 is depressed axially inwardly relative to the housing 102 (i.e., toward the bottom end wall of the fuel cell 100), a measured dose of fuel (not shown) is dispensed from the fuel metering chamber out through the fuel valve stem 180. Upon release of this axial inward force, the biasing element returns the fuel valve stem 180 to the closed position, and a subsequent dose of fuel flows into the fuel metering chamber for the next ignition or firing cycle.

In this illustrated embodiment, the fuel cell 100 is identical to the fuel cell 10, although it does not need to be identical. As shown in FIGS. 4, 5, 6, 7, 8, 9, and 10, the fuel cell 100 includes a sealing member 130 having a body including an outer ring 132 configured to engage the fuel cell closure 120. The ring 132 is configured to grip the fuel cell closure 120 to be non-rotatable with respect to the fuel cell closure 120 and thus the housing 102 of the fuel cell 100. The ring 132 includes a top edge 134, a bottom edge 136, an inner sidewall 138, and an outer sidewall 140. The inner side wall 138 of the sealing member 130 defines grooves 142 and 144 configured to receive the opposing extending tongues (not shown) of the known fuel cell adapter 20 to provide a tight and secure connection between the known adapter 20 and the fuel cell 10 (or the fuel cell 100). In this manner, the known fuel cell adapter 20 is configured to be rotated clockwise to screw into the sealing member 130 to create this secure connection between the sealing member 130 and the known adapter 20. Likewise, the known fuel cell adapter 20 is configured to be rotated counter-clockwise to screw out of the sealing member 130 to be released from the sealing member 130 and the known fuel cell 10 (or the fuel cell 100).

The present disclosure replaces the known fuel cell adapter 20 with the fuel cell adapter 200. This illustrated fuel cell adapter 200 includes a generally tapered or frustoconical tubular body 202 having an outer surface 204, an inner surface 206, a bottom edge 208, and a top portion 210. The outer surface 204 and the inner surface 206 are frustoconical or substantially frustoconical in this illustrated embodiment, while in other embodiments they are cylindrical. The fuel cell adapter 200 includes a locking flange or locking ring 220 extending radially outwardly from the top portion 210 of the body 202. The locking flange 220 may be part of the body 202. The locking flange 220 is ring-shaped in this illustrated embodiment. The fuel cell adapter 200 includes a plurality of spaced-apart elongated engagement lips or ridges 230 integrally formed with and extending outwardly from the entire outer surface 204 of the body 202. In this example embodiment, the engagement ridges 230 are circumferentially spaced around the body 202. The engagement ridges 230 longitudinally extend a substantial portion of the height of the fuel cell adapter 200, and particularly the height of the outer surface 204 of the body 202 in this illustrated embodiment. The fuel cell adapter 200 further includes a hub 240 positioned in and attached to the inner surface 206 of the body 202. The hub 240 includes a base 250 and a nozzle 270 extending from the base 250. The nozzle 270 is configured to fit over and engage the stem 180 of the fuel cell 100, as described in conjunction with a prior art fuel cell adapter in U.S. Pat. No. 7,478,740.

In this example embodiment, the engagement ridges 230 taper moving away from the locking flange 220 such that the engagement ridges 230 end before reaching the bottom edge 208 of the body 202 of the fuel cell adapter 200. This facilitates smooth attachment to and engagement with the fuel cell 100, as described below. In other embodiments, however, the engagement ridges 230 do not taper.

This illustrated fuel cell adapter 200, and particularly the tapered body 202 and the elongated engagement ridges 230 are sized and configured to provide a tight and secure connection between the adapter 200 and the sealing member 130 of the fuel cell 100. More specifically, the fuel cell adapter 200 is configured to be inserted into the sealing member 130—without requiring rotation of the fuel cell adapter 200 relative to the fuel cell 100—to create a secure connection between the sealing member 130 and the adapter 200. Likewise, the fuel cell adapter 200 is configured to be pulled out of the sealing member 130—without requiring rotation of the fuel cell adapter 200 relative to the fuel cell 100—to detach from the sealing member 130 and the fuel cell 100.

The fuel cell adapter cap 300 includes a body having a tapered or frustoconical wall 302 (though the wall may be cylindrical or substantially cylindrical in other embodiments). The wall 302 has an outer surface 304, an inner surface 306, a bottom edge 308, and a top end 310. The fuel cell adapter cap 300 further includes a substantially circular top wall 320 integrally connected to the top end 310 of the wall 302. The fuel cell adapter cap 300 further includes an engagement arm or engagement ring 330 extending radially outwardly from the wall 302. The engagement arm 330 includes a plurality of spaced apart downwardly extending engagement hands 342, 344, 346, and 348. Each engagement hand 342, 344, 346, and 348 respectively includes an inwardly extending engagement finger 352, 354, 356, and 358. The engagement arm 330; the engagement hands 342, 344, 346, and 348; and the engagement fingers 352, 354, 356, and 358 are configured to securely and releasably engage the outwardly extending locking flange 220 of the fuel cell adapter 200 as generally shown in FIGS. 4, 5, 6, 7, 8, 9, and 10. While this example embodiment includes four engagement hands, the fuel cell adapter cap may include any suitable quantity of engagement hands, such as three engagement hands.

The fuel cell adapter cap 300 is thus configured to be removably attached to the fuel cell adapter 200 (instead of to the fuel cell 100). The fuel cell 100, the fuel cell adapter 200, and the fuel cell adapter cap 300 of the present disclosure enable the fuel cell adapter 200 (and the fuel cell adapter cap 300) to be attached or interference fit to the fuel cell 100, and particularly the sealing member 130 of the fuel cell 100, in an efficient two-step process (as compared to the inefficient three-step process described above). To attach the fuel cell adapter 200 to the fuel cell 100, the assembler: (1) places the bottom of the fuel cell adapter 200 into the sealing member 130; and (2) pushes the fuel cell adapter 200 toward the sealing member 130 until secured. The assembler need not rotate the fuel cell adapter 200 at all.

Figure 9:
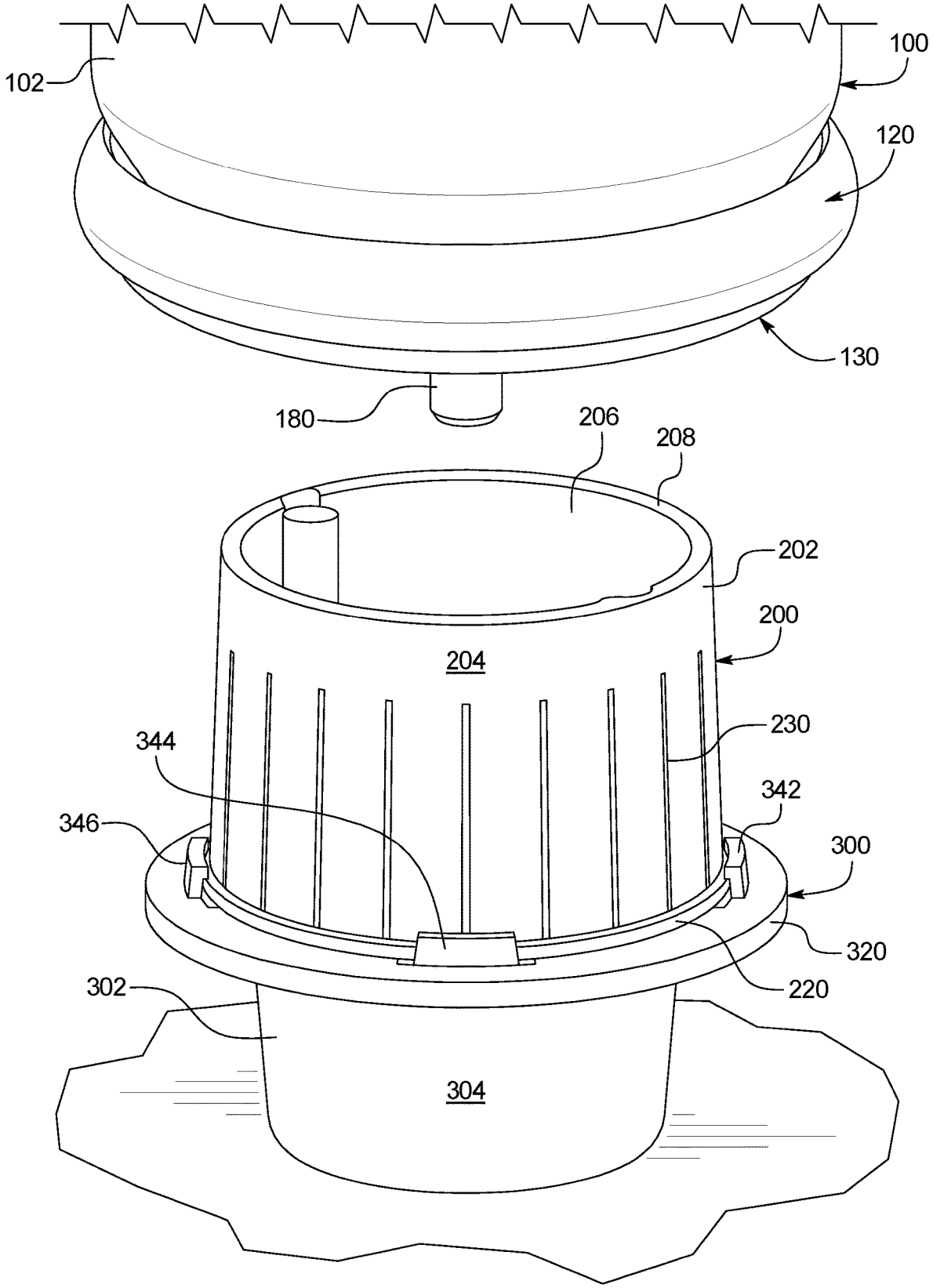
FIG. 9 is an front perspective view of the fuel cell (shown in fragmentary), the fuel cell adapter, and the fuel cell adapter cap of FIG. 4 upside-down with the fuel cell adapter removed from the fuel cell and the fuel cell adapter cap attached to the fuel cell adapter and resting on a supporting surface before the attachment of the fuel cell to the fuel cell adapter and the fuel cell adapter cap.

To facilitate installation, the fuel cell adapter cap 300 and the fuel cell adapter 200 can be positioned on a surface in an upside down position as shown in FIGS. 9 and 10. The fuel cell 100 can also be positioned in an upside down position above the fuel cell adapter 200 and moved downwardly onto the fuel cell adapter 200 such that the wall 200 of the fuel cell adapter 200 is securely inserted into the sealing member 130 of the fuel cell 100 (i.e., via interference fit). The tapered engagement ridges 230 facilitate a smooth lead-in to the sealing member 130 and the interference fit—installation crushes the engagement ridges 230 to ensure the sealing member 130 retains the fuel cell adapter 200.

This can be a manual or an automatic process, and is thus substantially more efficient and less time consuming than the installation process for the known fuel cell adapter 20 and known fuel cell cap 30. It should also be appreciated that the fuel cell adapter 200 and the fuel cell adapter cap 300 can be attached in a separate operation and/or in a separate facility before attachment to the fuel cell 100. This saves a substantial amount of time and expense.

The fuel cell adapter and the fuel cell adapter cap can be made from any suitable materials such as suitable plastic materials. In the illustrated embodiments, the fuel cell adapter is made from polyoxymethylene acetal resin and the fuel cell adapter cap is made from polypropylene.

It will be understood that modifications and variations may be effected without departing from the scope of the novel concepts of the present invention, and it is understood that this application is to be limited only by the scope of the claims.

The invention is claimed as follows:

1. A combustion-powered fastener driving tool fuel cell adapter comprising:

a tubular body having an outer surface, an inner surface, a bottom edge, and top portion;

a locking flange extending radially outward from the top portion of the tubular body;

a plurality of spaced-apart engagement ridges extending radially outwardly from the outer surface of the tubular body and that are sized and shaped to cause the tubular body to create an interference fit when inserted into a sealing member attached to a housing of a fuel cell; and a hub disposed within the tubular body and including a base and a nozzle extending from the base, the nozzle configured to fit over a stem of a fuel cell.

2. The combustion-powered fastener driving tool fuel cell adapter of claim 1, wherein the hub is attached to the inner surface of the tubular body.

3. A combustion-powered fastener driving tool fuel cell adapter comprising:

a tubular body having an outer surface, an inner surface, a bottom edge, and top portion, the tubular body configured to be interference fit into a sealing member attached to a housing of a fuel cell;

a locking flange extending radially outward from the top portion of the tubular body; and a hub disposed within the tubular body and including a base and a nozzle extending from the base, the nozzle configured to fit over a stem of the fuel cell; wherein the hub is attached to the inner surface of the tubular body.

4. The combustion-powered fastener driving tool fuel cell adapter of claim 3, wherein the tubular body is tapered from a first end to a second end.

5. The combustion-powered fastener driving tool fuel cell adapter of claim 4, which includes a plurality of spaced-apart engagement ridges extending radially outwardly from the outer surface of the tubular body and that are sized and shaped to cause the tubular body to create the interference fit when inserted into a sealing member attached to a housing of a fuel cell.

6. A combustion-powered fastener driving tool fuel cell adapter comprising:

a tubular body having an outer surface, an inner surface, a bottom edge, and top portion, the tubular body configured to be interference fit without rotation into a sealing member attached to a housing of a fuel cell; and a hub disposed within the tubular body and including a base and a nozzle extending from the base, the nozzle configured to fit over a stem of the fuel cell; wherein the hub is attached to the inner surface of the tubular body.

7. The combustion-powered fastener driving tool fuel cell adapter of claim 6, wherein the tubular body is tapered from a first end to a second end.

8. The combustion-powered fastener driving tool fuel cell adapter of claim 7, which includes a plurality of spaced-apart engagement ridges extending radially outwardly from the outer surface of the tubular body and that are sized and shaped to cause the tubular body to create the interference fit when inserted into the sealing member attached to the housing of the fuel cell.

* * * * *